US010867780B2

(12) United States Patent
Schwieters et al.

(10) Patent No.: US 10,867,780 B2
(45) Date of Patent: Dec. 15, 2020

(54) MULTI DETECTOR MASS SPECTROMETER AND SPECTROMETRY METHOD FILTER

(71) Applicants: Thermo Fisher Scientific (Bremen) GmbH, Bremen (DE); The University of Bristol, Bristol (GB)

(72) Inventors: Johannes Schwieters, Ganderkesee (DE); Timothy Richard Elliott, Bristol (GB); Christopher David Coath, Bristol (GB)

(73) Assignees: Thermo Fisher Scientific (Bremen) GmbH, Bremen (DE); The University of Bristol, Bristol (GB)

( * ) Notice: Subject to any disclaimer, the term of this patent is extended or adjusted under 35 U.S.C. 154(b) by 0 days.

(21) Appl. No.: 15/752,871

(22) PCT Filed: Aug. 11, 2016

(86) PCT No.: PCT/EP2016/069180
§ 371 (c)(1),
(2) Date: Feb. 14, 2018

(87) PCT Pub. No.: WO2017/029200
PCT Pub. Date: Feb. 23, 2017

(65) Prior Publication Data

US 2018/0308674 A1 Oct. 25, 2018

(30) Foreign Application Priority Data

Aug. 14, 2015 (GB) ..... 1514478.5

(51) Int. Cl.
*H01J 49/28* (2006.01)
*H01J 49/02* (2006.01)
(Continued)

(52) U.S. Cl.
CPC ..... *H01J 49/025* (2013.01); *H01J 49/0045* (2013.01); *H01J 49/105* (2013.01); *H01J 49/28* (2013.01)

(58) Field of Classification Search
CPC ..... H01J 49/28; H01J 49/284; H01J 49/30; H01J 49/305; H01J 49/32; H01J 49/322;
(Continued)

(56) References Cited

U.S. PATENT DOCUMENTS 4,472,631 A 9/1984 Enke et al.
4,952,803 A 8/1990 Matsuda
(Continued)

FOREIGN PATENT DOCUMENTS

EP 0813228 A1 12/1997
WO 97/25737 A1 7/1997
WO 2012/007559 A2 1/2012

OTHER PUBLICATIONS

Douglas, D. J., "Some Current Perspectives on ICP-MS", Canadian Journal of Spectroscopy, 1989, vol. 34 (2), pp. 38-49.
(Continued)

*Primary Examiner* — Eliza W Osenbaugh-Stewart
(74) *Attorney, Agent, or Firm* — David A. Schell

(57) ABSTRACT

The present invention can be directed to a mass spectrometer, relevant parts thereof like replacement kits or upgrading kits and/or mass spectrometry methods. A mass spectrometer according to the present invention can comprise at least one ion source for generating a beam of ions from a sample. Moreover at least one mass filter downstream of the ion source can be provided and adapted to select ions from the beam by their mass-to-charge ratio (m/z). Furthermore at least one collision cell arranged downstream of the mass filter can be arranged. At least one sector field mass analyser arranged downstream of the collision cell can be further
(Continued)

provided and at least one ion multicollector comprising a plurality of ion detectors arranged downstream of the mass analyser, for detecting a plurality of different ion species in parallel and/or simultaneously.

30 Claims, 9 Drawing Sheets

(51) Int. Cl.
*H01J 49/00* (2006.01)
*H01J 49/10* (2006.01)

(58) Field of Classification Search
CPC .... H01J 49/324; H01J 49/326; H01J 49/0045; H01J 49/0077
See application file for complete search history.

(56) References Cited

U.S. PATENT DOCUMENTS 5,049,739 A 9/1991 Okamoto
5,073,713 A 12/1991 Smith et al.
5,767,512 A 6/1998 Eiden et al.
6,259,091 B1 7/2001 Eiden et al.
7,202,470 B1 4/2007 Marriott
8,592,757 B2 11/2013 Schwieters et al.
2002/0145110 A1* 10/2002 Holle ..... H01J 49/161 250/287
2004/0056189 A1* 3/2004 Tanner ..... H01J 49/044 250/287
2005/0098719 A1* 5/2005 Thomson ..... H01J 49/0081 250/288
2015/0318159 A1* 11/2015 Badiei ..... H01J 49/105 250/282

OTHER PUBLICATIONS

Eiden et al., "Selective Removal of Plasma Matrix Ions in Plasma Source Mass Spectrometry," J. Anal. At. Spec., 11, 317-322, 1996.
Hattendorf et al., "Suppression of in-cell generated interferences in a reaction cell ICP-MS by bandpass tuning and kinetic energy discrimination," J. Anal. At. Spectrom., 2004, 19, pp. 600-606.
Holland et al., "Reaction Cells and High Resolution. Determination of 44CA-Isotope Markers for Parasitoid Studies Using Dynamic Reaction Cell ICPMS", Special Publication, Royal Society of Chemistry, 2005, vol. 301, pp. 91-98.
Koppenaal et al., "Collision and reaction cells in atomic mass spectrometry: development, status, and applications," J. Anal. At. Spectrom., 19, 561-570, 2004.
Thermo Scientific, "Neptune Plus Multicollector ICPMS—Another step ahead in MC-ICP-MS", 2010, pp. 1-12.
Thermo Scientific, "Thermo Scientific Neptune Multicollector ICP-MS—High Resolution Multicollector Mass Spectrometers"—brochure, 2007, pp. 1-16.
Thomas, R., "A Beginner's Guide to ICP-MS—Part XII—A Review of Interferences", Spectroscopy 17 (10), 2002, pp. 24-31.
Weyer et al., "High precision Fe isotope measurements with high mass resolution MC-ICPMS," Int. J. Mass Spec., 226, 355-368, 2003.

* cited by examiner

MULTI DETECTOR MASS SPECTROMETER AND SPECTROMETRY METHOD FILTER

FIELD

The invention relates to mass spectrometry. The invention furthermore relates to Inductively Coupled Plasma Mass Spectrometry (ICP-MS) and collision cell technology.

INTRODUCTION

In order to achieve high precision and accurate isotope ratio measurements extended physical and chemical sample preparation is applied to get clean samples free from possible interferences and contaminations in the mass spectrum. Typical concentrations of analyte in the sample material can be in the range of parts per billion in the analyte of interest and may be concentrated in small inclusions or crystals within a heterogeneous sample material.

Extended quality control steps are integrated into the sample preparation to ensure that the sample preparation itself does not lead to changes in the isotope ratio of the sample material. Every sample preparation step comes along with the possibility of adding contamination to the samples and isotopic fractionation of the analyte to be extracted from the original sample material, which could be for instance a rock, a crystal, soil, a dust particle, a liquid and/or organic matter. Even if all these steps are taken with great care there still is the chance of contamination and incomplete separation and interferences in the mass spectrum.

Ideally one would like to completely avoid the chemical sample preparation step. Moreover a chemical sample preparation is impossible if a laser is used to directly ablate the sample and flush the ablated material into an ion source. In this case there is no chemical separation of the desired analyte from the sample matrix and all the specificity has to come through the mass analyzer and the introduction system to the mass analyzer. Specificity describes the ability of an analyzer to unambiguously determine and identify a certain species in a sample. One way to achieve specificity in a mass spectrometer is to ensure that the mass resolving power $M/\Delta M$ of the mass analyzer is large enough to clearly separate one species from another species where $\Delta M$ is meant to be the mass difference of both species and M is the mass of the species of interest. This requires very high mass resolution in case of isobaric interferences of species with the same nominal mass. For sector field mass spectrometers high mass resolution comes along with using very narrow entrance slits to the mass analyzer and the small entrance slits significantly reduces the transmission and thus the sensitivity of the mass analyzer and becomes an unpractical approach where very high mass resolving power is required, such as considerably more than 10,000. This is a special challenge for mass spectrometry instrumentation where today's options of instrumentation are limited.

The Inductively Coupled Plasma (ICP) ion source is a very efficient ion source for elemental and isotopic analysis using mass spectrometry. This is an analytical method that is capable of detecting elements at very low concentration, as low as one part in $10^{15}$ (part per quadrillion, ppq) on non-interfered, low-background isotopes. The method involves ionizing the sample to be analysed with an inductively coupled plasma and then using a mass spectrometer to separate and quantify the thus generated ions.

Ionizing a gas, usually argon, in an electromagnetic coil, to generate a highly energized mixture of argon atoms, free electrons and argon ions, generates the plasma, in which the temperature is high enough to cause atomization and ionisation of the sample. The ions produced are introduced, via one or more stages of pressure reduction, into a mass analyser which is most commonly a quadrupole analyser, a magnetic sector analyser or a time-of-flight analyser.

A description of ICP mass spectrometers can be found in the articles *A Beginner's Guide to ICP-MS* by Robert Thomas (SPECTROSCOPY 16(4)-18(2), April 2001-February 2003), the disclosure of which is hereby incorporated by reference in its entirety (however, where anything in the incorporated reference contradicts anything stated in the present application, the present application prevails).

A known design of multi-collector (MC) ICPMS instrument is the NEPTUNE™ or NEPTUNE Plus™, as described in brochures and operating manuals from Thermo Scientific, the disclosures of which are hereby incorporated by reference in their entirety (however, where anything in the incorporated reference contradicts anything stated in the present application, the present application prevails).

Certain elements are known to have relatively poor detection limits by ICP-MS. These elements are predominantly those that suffer from artefacts or spectral interferences due to molecular and atomic ions that are generated inside the ICP source derived from the plasma gas, matrix components and/or the solvent used to solubilize samples (e.g. $OH^+$, $NO^+$, $CO^+$, $CO_2^+$, $Ar^+$, $ArO^+$, $ArN^+$, $ArAr^+$, $Ar^{++}$ etc.). Examples of interferences include $^{40}Ar^{16}O$ for determination of $^{56}Fe$, $^{38}ArH$ for determination of $^{39}K$, $^{40}Ar$ for determination of $^{40}Ca$, $^{40}Ar^{40}Ar$ for determination of $^{80}Se$, $^{40}Ar^{35}Cl$ for determination of $^{75}As$, $^{40}Ar^{12}C$ for determination of $^{52}Cr$ and $^{35}Cl^{16}O$ for determination of $^{51}V$.

With a high mass resolution magnetic sector multicollector mass spectrometer the molecular species can be separated along the focal plane of the mass spectrometer so that just the elemental ions can be detected while the molecular interferences are discriminated at the detector slit (see Weyer & Schwieters, International Journal of Mass Spectrometry, Vol. 226, Number 3, May 2003; herein incorporated by reference). This procedure works well for interferences where the relative mass deviation between the analyte and the interference is in the range of $(M/\Delta M)<2{,}000$-$10{,}000$. PCT/EP2011/062095 shows such pre-slit deflection device which is herewith incorporated by reference.

With a sector mass spectrometer high mass resolution usually comes along with reduced ion optical transmission (transmission typical in the range of 10% to 0.1%) to the mass analyser because high mass resolution requires narrower entrance slits and smaller apertures in front of an electro-static and a magnetic sector to limit the angular acceptance of the ion optics and minimize second or third order angular aberrations further down the ion beam path from the entrance slit to the detector. In the particular case where the amount of sample is limited or the analyte concentration in a sample is low the reduced sensitivity in high mass resolution mode is a significant problem. It directly results in reduced analytical precision because of poorer counting statistics at effectively reduced transmission through the sector field analyser. Therefore high mass resolution is not generally a practical solution to eliminate interferences and to gain specificity even in cases where the mass resolving power of the mass spectrometer would be sufficient to discriminate the interferences.

There are other applications in the field where so-called isobaric interferences on elemental ions cannot be avoided by sample preparation and where mass resolving power $>>10{,}000$ would be required to separate the interfering species. One example is the analysis of $^{40}Ca$ with argon based plasma. There is a strong interference of elemental $^{40}Ar^+$ on $^{40}Ca^+$. The required mass resolution to separate both species would be >193,000 which is much greater than that which can be achieved by a magnetic sector field analyser.

One solution to this problem is provided by collision cell technology (ICP-CCT) that includes a collision/reaction cell that is positioned before the analyser. This collision cell adds another possibility to achieve specificity for the analysis. Instead of mass resolving power it uses chemical reactions to distinguish between interfering species. Into this cell, which typically comprises a multipole operating in a radiofrequency mode to focus the ions, a collision gas such as helium or hydrogen is introduced. The collision gas collides and reacts with the ions in the cell, to convert interfering ions to harmless non-interfering species.

A collision cell may be used to remove undesired artefact ions from an elemental mass spectrum. The use of a collision cell is described, e.g., in EP 0 813 228 A1, WO 97/25737 or U.S. Pat. No. 5,049,739 B, all herein incorporated by reference. A collision cell is a substantially gas-tight enclosure through which ions are transmitted. It is positioned between the ion source and the main mass analyser. A target gas (molecular and/or atomic) is admitted into the collision cell, with the objective of promoting collisions between ions and the neutral gas molecules or atoms. The collision cell may be a passive cell, as disclosed in U.S. Pat. No. 5,049,739 B, or the ions may be confined in the cell by means of ion optics, for example a multipole which is driven with alternating voltages or a combination of alternating and direct voltages, as in EP 0 813 228. By this means the collision cell can be configured so as to transmit ions with minimal losses, even when the cell is operated at a pressure that is high enough to guarantee many collisions between the ions and the gas molecules. The documents mentioned before are herein incorporated by reference.

For example, the use of a collision cell where about 2% $H_2$ is added to He gas inside the cell selectively neutralizes $^{40}Ar^+$ ion by low energy collisions of the $^{40}Ar^+$ with the $H_2$ gas and a resonant charge transfer of an electron from the $H_2$ gas to neutralize the $^{40}Ar^+$ ions (see U.S. Pat. Nos. 5,767,512 and 6,259,091; herein incorporated by reference). This charge transfer mechanism is very selective and efficiently neutralizes argon ions and thus discriminates Argon ions from $^{40}Ca^+$. These mechanisms are called chemical resolution using reaction and collision cells in comparison to mass resolution in the case of mass spectrometer. See also Scott D. Tanner, Grenville Holland, Plasma Source Mass Spectrometry: The New Millenium; Jun. 1, 2001; Royal Society of Chemistry; herein incorporated by reference).

In addition to the charge transfer reactions, other mechanisms inside the collision cell using other collision gases or mixtures of collision gases may be applied to reduce interferences. These mechanisms include: kinetic energy discrimination due to collisions inside the collision cell (e.g., B. Hattendorf & D. Guenther, Suppression of In-Cell generated Interferences in a Reaction Cell ICPMS by Bandpass Tuning and Kinetic Energy Discrimination, 2004, Journal of Analytical Atomic Spectroscopy, Vol. 19, p.: 600 herein incorporated by reference), fragmentation of molecular species inside the collision cell (see Koppenaal, D., W., Eiden, G., C. and Barinaga, C., J., (2004), *Collision and reaction cells in atomic mass spectrometry: development, status, and applications*, Journal of Analytical Atomic Spectroscopy, Volume 19, p.: 561-570; herein incorporated by reference), and/or mass shift reactions inside the collision cell. This toolbox of the ICP-CCT can come closer to the goal of detection specificity using direct sample analysis with significantly reduced sample preparation but there are still analytical problems and interferences which cannot be resolved by interfacing a collision cell to a mass spectrometer.

By careful control of the conditions in the collision cell, it is possible to transmit the desired ions efficiently. This is possible because in general the desired ions, those that form part of the mass spectrum to be analysed, are monatomic and carry a single positive charge, that is, they have lost an electron. If such an ion collides with a neutral gas atom or molecule, the ion will retain its positive charge unless the first ionisation potential of the gas is low enough for an electron to transfer to the ion and neutralise it. Consequently, gases with high ionisation potentials are ideal target gases. Conversely, it is possible to remove undesired artefact ions whilst continuing to transmit the desired ions efficiently. For example the artefact ions may be molecular ions such as $ArO^+$ or $Ar_2^+$ which are much less stable than the atomic ions. In a collision with a neutral gas atom or molecule, a molecular ion may dissociate, forming a new ion of lower mass and one or more neutral fragments. In addition, the collision cross section for collisions involving a molecular ion tends to be greater than for an atomic ion. This was demonstrated by Douglas (Canadian Journal Spectroscopy, 1989 vol 34(2) pp 36-49, incorporated herein by reference). Another possibility is to utilise reactive collisions. Eiden et al. (Journal of Analytical Atomic Spectrometry vol 11 pp 317~322 (1996), herewith incorporated by reference) used hydrogen to eliminate many molecular ions and also Ark, whilst monatomic analyte ions remain largely unaffected. In JAAS, September 1998, Vol. 13 (1021-1025) an instrument design with a collision cell in accordance with the before principles is shown, herewith incorporated by reference.

U.S. Pat. No. 7,202,470 B1, herein incorporated by reference, relates to inductively coupled plasma mass spectrometry (ICP-MS) in which a collision cell is employed to selectively remove undesired artefact ions from an ion beam by causing them to interact with a reagent gas. A first evacuated chamber is provided at high vacuum located between an expansion chamber and a second evacuated chamber containing the collision cell. The first evacuated chamber (6) includes a first ion optical device. The collision cell contains a second ion optical device. The provision of the first evacuated chamber reduces the gas load on the collision cell by minimising the residual pressure within the collision cell that is attributable to the gas load from the plasma source. This serves to minimise the formation, or re-formation of undesired artefact ions in the collision cell.

U.S. Pat. No. 8,592,757 B1, herein incorporated by reference, relates to a mass spectrometer for analysing isotopic signatures, with at least one magnetic analyser and optionally with an electric analyser with a first arrangement of ion detectors and/or ion passages and, arranged downstream thereof in the direction of the ion beam, a second arrangement of ion detectors, with at least one deflector in the region of the two arrangements of ion detectors or between these arrangements. The mass spectrometer according to this document has a control for the at least one deflector such that ion beams of different isotopes can be routed to at least one ion detector in the second arrangement.

SUMMARY

The present invention is specified in the claims as well as in the below description. Preferred embodiments are particularly specified in the dependent claims and the description of various embodiments.

The present invention is directed to a mass spectrometer, relevant parts thereof, like replacement kits or upgrading kits, and/or mass spectrometry methods and relevant parts thereof. A mass spectrometer according to the present invention can comprise at least one ion source for generating a beam of ions from a sample. Moreover at least one mass filter downstream of the ion source can be provided and adapted to select ions from the beam by their mass-to-charge ratio (m/z). Furthermore at least one collision cell arranged downstream of the mass filter can be arranged. At least one sector field mass analyser arranged downstream of the collision cell can be further provided and at least one ion multicollector comprising a plurality of ion detectors arranged downstream of the mass analyser, for detecting a plurality of different ion species in parallel and/or simultaneously. Detection in parallel and/or simultaneously means a detection of at least two or more ions at the same time or essentially at the same time and/or not subsequently in one detector. Ion species may be of different elements and/or different isotopes of the same element.

The mass filter can comprise a quadrupole mass filter.

The ion source can comprise an inductively coupled plasma ion source which is usually abbreviated ICP in the field. A respective mass spectrometer is also abbreviated ICP-MS.

Moreover, a laser ablation cell can be arranged for direct laser ablation of a sample, the laser ablation cell being arranged upstream of the ion source.

The mass filter can comprise a quadrupole filter, an RF-only driven pre-filter section arranged upstream of the quadrupole filter and/or RF-only driven post-filter section arranged downstream of the quadrupole filter. The pre-filter section and the post-filter section can form a so-called fringing field. The quadrupole filter can also be adapted to be operable in a full mass transmission mode so that in this mode ions are not filtered by their mass to charge ratio. The pre-filter section can be adapted to enhance control of the ion beam phase volume at the entrance of and/or within the quadrupole filter and/or to enhance transmission of the ion beam further downstream. The post-filter section can also be adapted to enhance control of the ion beam phase volume at the exit of the mass filter and/or to enhance transmission of the ion beam further downstream. This may ensure efficient beam transport across a selected mass range, and, thus, significant mass discriminations may be avoided across a window of selected mass or masses and accurate and high precision isotope ratio measurements may be achieved.

Further, at least one high voltage and focussing accelerator can be arranged downstream of the collision cell, preferably for guiding and focussing the ion beam.

The mass spectrometer according to the invention can also comprise at least one mass analyser comprising either single focusing or double focusing ion optics for simultaneously analysing a plurality of ion species. The mass analyser in double focusing embodiments preferably comprises an electro-static sector and/or a magnetic sector. In case of the formation of an electro-static sector and a magnetic sector double focusing ion optics, a Nier-Johnson geometry can be realized. Where the mass analyser comprises single focusing ion optics, a magnetic sector is preferably employed.

Downstream the magnetic sector dispersion optics can be arranged to change the mass dispersion and improve peak detection.

The ion multicollector can comprise at least one Faraday cup and/or at least one ion counter, preferably a plurality of Faraday cups and a plurality of ion counters. Secondary electron multipliers (SEM) may be used. The ion counters can be miniaturized and can be assembled to either side of a corresponding Faraday cup. The ion multicollector can comprise at least 3 (three) Faraday cups and/or 2 (two) ion counters, preferably at least 5 (five) Faraday cups and/or 4 (four) ion counters, more preferably at least 7 (seven) Faraday cups and/or 6 (six) ion counters and most preferably 9 (nine) Faraday cups and/or 8 (eight) ion counters.

The multicollector can comprise at least one axial channel that comprises at least one switchable collector channel behind a detector slit for switching between a Faraday cup and an ion counter.

On each side of the axial channel 4 (four) movable detector platforms can be arranged, preferably each supporting at least one Faraday cup and at least one ion counter, the ion counter being preferably miniaturized. Generally, every second detector platform, preferably counted from an axial or central channel, can be motorized and preferably adjustable under computer control. The detector platforms between the motorized platforms can be adapted to be pushed into position by the motorized platforms for full position control of all moveable platforms.

The mass filter can further be adapted to be operable to transmit mass within a predefined mass window. In this case, the mass filter can be operated to transmit only ions having a mass within a mass window of at most 30 (thirty) amu (atomic mass unit) around a pre-defined mass, preferably of at most 24 (twenty-four) amu around a pre-defined mass, more preferably of at most 20 (twenty) amu around a pre-defined mass, even more preferably of at most 18 (eighteen) amu around a pre-defined mass, even more preferably of at most 16 (sixteen) amu around a pre-defined mass, even more preferably of at most around 14 (fourteen) amu around a pre-defined mass, even more preferably of at most around 12 (twelve) amu around a pre-defined mass, even more preferably of at most around 10 (ten) amu around a pre-defined mass, even more preferably of at most around 8 (eight) amu around a pre-defined mass, even more preferably of at most around 6 (six) amu around a pre-defined mass, even more preferably of at most 4 (four) amu around a pre-defined mass and most preferably of at most around 3 (three) amu around a pre-defined mass. The atomic mass unit amu is alternatively abbreviated with "u". The term "mass window" is intended to mean a tolerance field around a given mass, the given mass generally lying in the centre of the tolerance field.

The mass filter can also be adapted to be operable to transmit only ions having a mass within a mass window around a predefined mass, wherein the mass window has a width of at most 30% (thirty %), or of at most 20% (twenty %), or of at most 10% (ten %) of the predefined mass.

Further, the mass filter can be adapted to be operable to transmit only ions having a mass within a mass window around a predefined mass, wherein the width of the mass window is selected based on the ion mass range transmitted by the mass analyser to the multicollector. The width of the mass window preferably is not greater or substantially greater than the range of ion masses detected in parallel by the multicollector.

The mass filter can be adapted to be operable to (i) transmit only ions having a mass within a first mass window during a first time period in which the mass analyser is set to transmit ions of a first analysis mass range to the multicollector, the first mass window being selected based on the first analysis mass range. The mass filter can also (ii) transmit only ions having a mass within a second mass window during a second time period, following the first time period, in which the mass analyser is set to transmit ions of a second analysis mass range to the multicollector, the second mass window being selected based on the second analysis mass range, wherein the second analysis mass range is different to the first analysis mass range.

The quadrupole mass filter can be adapted to transmit a single mass with a mass window of at most 0.9 amu, preferably at most 0.8 amu and most preferably at most 0.7 amu.

A filter can be provided for removing non-ionic species, the filter being arranged upstream from the mass filter.

In general, the collision cell preferably contains at least one gas inlet for supplying a collision gas or reactive gas into the cell. One, or two, or more gases can be supplied to the cell through a gas inlet. Alternatively, the cell may comprise two or more gas inlets for respectively supplying two or more collision and/or reactive gases into the cell. The collision cell of the mass spectrometer according to the present invention can further comprise at least one source of gas, preferably He gas, and at least one gas inlet into the collision cell and at least one source of a second gas, preferably $O_2$, and at least one second gas inlet into the collision cell and/or mixtures of these and/or other gases. He can preferably cool down the ion beam in the collision cell. By cooling the ion beam the collision gas can preferably reduce both the absolute kinetic energy of the ions in the ion beam and also reduce the spread of kinetic energies which the ions have.

As mentioned before the present invention is also directed to a kit for a multi-detector mass spectrometer, particularly according to the description before and hereafter. The kit comprises at least one mass filter to select ions from the beam by their mass-to-charge ratio (m/z). The mass filter is adapted to be arranged downstream of the ion source and to be arranged upstream of at least one collision cell and at least one sector field mass analyser, arranged downstream of the collision cell and at least one ion multicollector comprising a plurality of ion detectors arranged downstream of the mass analyser, for detecting a plurality of different ion species in parallel and/or simultaneously. The kit can comprise a quadrupole as the mass filter or one of the mass filters.

The present invention is also directed to a method of analysing the composition of at least one sample and/or determining at least one elemental ratio, particularly with a mass spectrometer as described before and hereinafter and with the respective method steps. The method can comprise the steps of generating a beam of ions from a sample in an ion source, selecting ions of the ion beam by at least one mass filter downstream of the ion source operable to selectively transmit only ions with mass to charge ratio (m/z) in a pre-determined range, transmitting the selected ions through at least one collision cell downstream of the mass filter wherein the ions are optionally further selected and/or mass-shifted, separating the ions transmitted from the collision cell in a sector field analyser based on their mass to charge ratio (m/z), and detecting the separated ions in a multicollector in parallel and/or simultaneously. The mass filter is also operable or can be operated to transmit the full mass range when required. These steps can be in the order as described before.

Analysing the composition can comprise determining an isotopic ratio in the sample. The method can also assist to determine an elemental ratio, i.e. ratio of different elements, not an isotopic ratio.

According to the method and as also described before, the ions can be generated by an inductively coupled plasma ion source (ICP).

A step of preparing the sample from a geological, geochemical and/or biogeochemical resource can be provided before generating the beam and a step of determining and/or measuring of isotope ratios of isotopes contained in the sample can be provided after the detecting step.

A step of preparing the sample from a cosmological and/or cosmochemical resource can be provided before generating the beam and a step of determining and/or measuring of isotope ratios of isotopes contained in the sample can be provided after the detecting step.

A step of preparing the sample from a life science resource can be provided before generating the beam and a step of determining and/or measuring isotope ratios of isotopes contained in the sample can be provided after the detecting step.

Before generating the beam a step of providing a sample by laser ablation can be provided.

The ratio of at least two isotopes can be analysed, preferably simultaneously by means of the multicollector.

Moreover, the method can comprise a step of delivering He as a major gas into the collision cell, preferably for cooling down the ion beam in the collision cell, and can preferably also comprise 5%-15% $O_2$ and more preferably 10% $O_2$ as a second gas works, preferably for inducing oxidative mass shifts.

The mass filter can be operated (i) to transmit only ions having a mass within a first mass window during a first time period in which the mass analyser is set to transmit ions of a first analysis mass range to the multicollector, the first mass window being selected based on the first analysis mass range, and/or (ii) to transmit only ions having a mass within a second mass window during a second time period, following the first time period, in which the mass analyser is set to transmit ions of a second analysis mass range to the multicollector, the second mass window being selected based on the second analysis mass range, wherein the second analysis mass range is different to the first analysis mass range. Optionally there can be at least one further time period, i.e. a third time period during which only ions within a third mass window are transmitted, a fourth time period, and so on. Preferably, the additional mass windows are different from the first and second mass windows.

The above features along with additional details of the invention, are described further in the examples below, which are intended to further illustrate the invention but are not intended to limit its scope in any way.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

In the following description, a series of features and/or steps are described. The skilled person will appreciate that unless required by the context, the order of features and steps is not critical for the resulting configuration and its effect. Further, it will be apparent to the skilled person that irrespective of the order of features and steps, the presence or absence of time delay between steps, can be present between some or all of the described steps.

Figure 1:
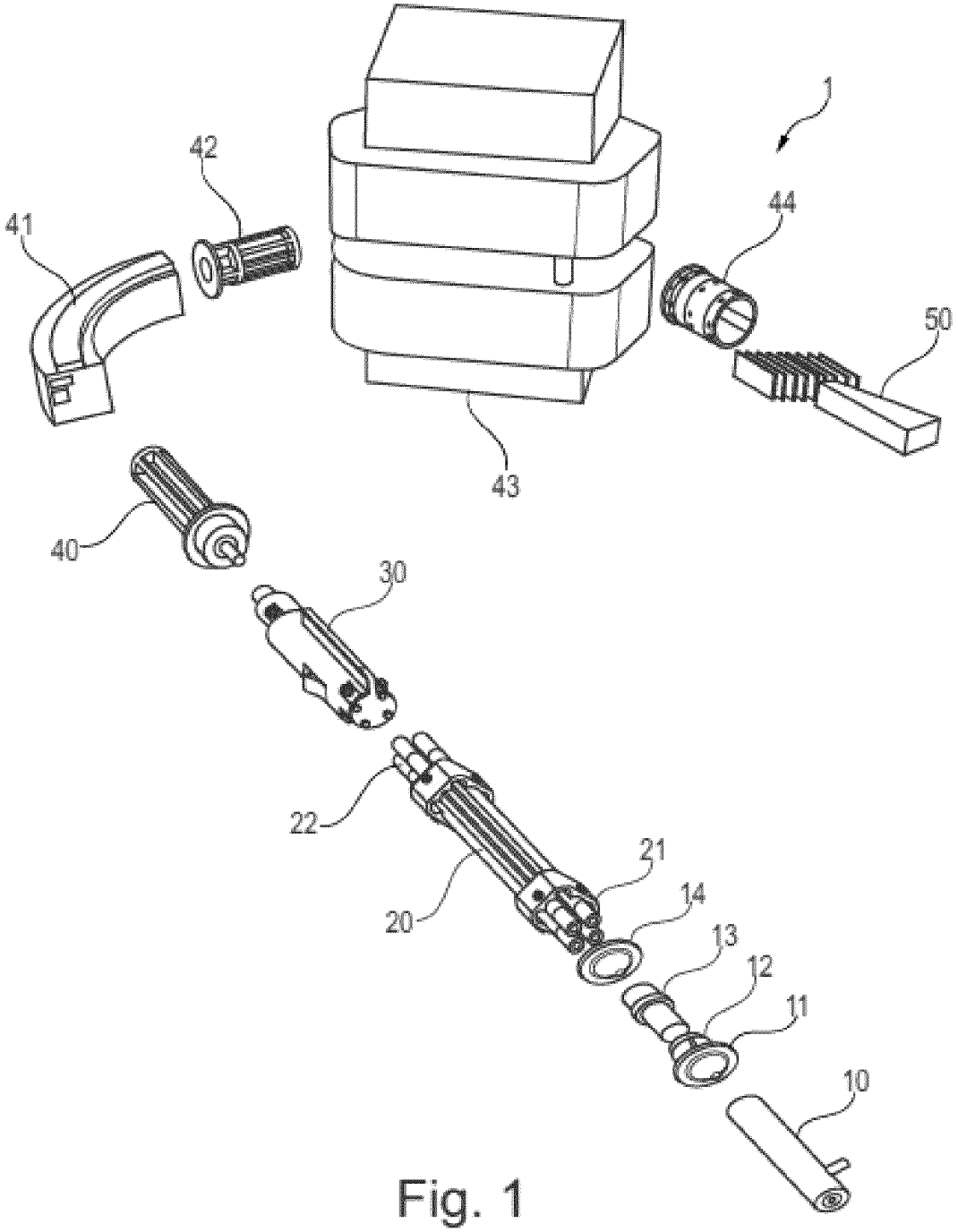
FIG. 1 shows an embodiment of a mass spectrometer according to the invention.

Referring to FIG. 1 an example of a setup of the present invention is shown. Mass spectrometer 1 is shown with the mass spectrometer 1 optionally having a triaxial ICP torch 10. A sampler cone 11, one (or more) skimmer cone(s) 12, an extraction lens 13 and/or a further skimmer cone 14 and/or another ion optical device 14 can also be present in order to provide the ICP ion source such that a collimated ion beam can be produced by the ion source.

A mass filter 20, such as a quadrupole 20, can be arranged directly downstream the elements mentioned before. Downstream the mass filter 20 a collision cell 30 can be arranged, which may be a HCD (high energy dissociation) cell, which can be heated up to 100-200° C.

After the ions have passed through the collision cell an accelerator 40 can accelerate them to high voltage to be focused into the ion optics of a double focusing high resolution multicollector mass spectrometer to allow for simultaneous measurement of multiple isotopes and/or some monitoring species.

An electro-static sector 41 can be arranged downstream of the accelerator 40 in order to disperse ions by the energy and thus provide focusing for ions of the same energy. Downstream the electro-static sector 41 a focussing lens 42 can be arranged upstream a magnetic sector 43. The magnetic sector 43 can disperse the ions by masses (mass-to-charge ratios). The electro-static sector 41 and the magnetic sector 43 can be arranged in a so-called Nier-Johnson-Geometry for use of a scanning magnetic sector 43 in order to sequentially focus ions with different m/z ratios.

Downstream the magnetic sector 43, dispersion optics 44 can be arranged to change the mass dispersion and improve peak detection. Such optics are employed e.g. on the Neptune™ multi-collector mass spectrometer (Thermo Scientific). Further downstream, a detector platform 50 can be arranged. The instrument can, e.g., cover 16% relative mass range along the focal plane. The detector platform 50 can comprise 9 Faraday cups plus a maximum of 8 (eight) ion counters.

Figure 2:
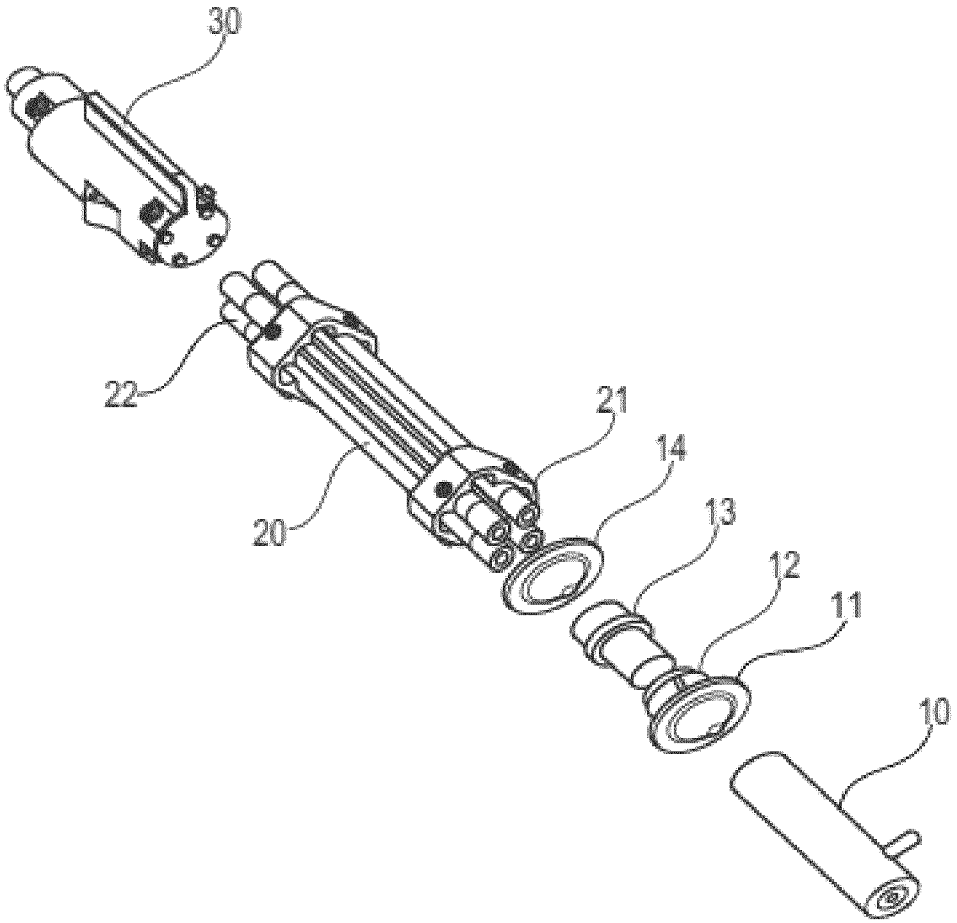
FIG. 2 shows an enlarged portion of the mass spectrometer according to FIG. 1.

FIG. 2 shows an enlarged portion of the elements according to FIG. 1. As mentioned, the ICP torch 10 and the ICP interface comprise sampler cone 11 the one or more skimmer cones 12, 14 and/or extraction lens 13 and/or another ion optical device 14 can be arranged. The quadrupole mass filter 20 can be arranged downstream of the ICP interface 11, 12, 13, 14.

Upstream the quadrupole mass filter 20 a pre-filter section 21 and/or downstream the quadrupole a post-filter section 22 can be positioned. The mass filter 20 can be user controlled to only transmit a single mass with a mass window as stated above and in the claims, e.g., with a width of 0.7 amu or less and/or to select a larger mass window capable of transmitting all isotopes of an element but discriminating against neighbouring masses, e.g., a window from mass 45 to mass 51, e.g., in case of Ti. The pre-filter section 21 and/or the post-filter section 22 can usually be set to full mass transmission mode with little or no DC potential in order to facilitate ion optical focussing. In case of no mass discrimination also the quadrupole 20 acts only as an ion guide and its DC potential can be set to zero as well (only RF mode).

The present invention can apply RF-only driven pre- and post- filter sections 21,22 to the quadrupole 20 to achieve high transmission at the quadrupole entrance but also to better control the ion beam phase volume (i.e., both position and angle of ions entering or leaving an ion optical device) at the exit of the quadrupole in order to assure high transmission further down the ion optical arrangement.

Just upstream the pre-filter section 21 the skimmer cone 14 or another ion optical device 14 can be arranged.

Downstream the exit of the quadrupole 20 a lens (not shown) can be arranged which focuses the ion beam from the exit of the quadrupole mass filter 20 to the entrance of the collision cell 30.

The mass filter 20 can be pumped to, e.g., $10^{-6}$ to $10^{-7}$ mbar. The mass filter is generally arranged to be held at lower pressure than the collision cell in operation.

The collision cell 30 can be flooded with different gases and gas mixtures. The collision cell is pumped by a vacuum pump. The collision/reaction cell can operate at a pressure from about $5*10^{-3}$ to about $10^{-5}$ mbar. When a collision/reaction gas is provided in the cell, its pressure can be about $5*10^{-3}$ mbar, depending on the flow rate of the gas into the cell. For example, when reaction/collision gas is provided in the cell at a flow rate of about 1 mL/min, the pressure in the cell can be about $2\times10^{-3}$ mbar. In most cases He is used for collisions and a reactive gas can be added to stimulate chemistry inside the collision cell 30. For instance the addition of $O_2$ for some elements results in the formation of oxides. Other reactive gases could be $NH_3$, $SO_2$ or $H_2$. Without a gas flow the pressure in the collision cell can be as low as the mass filter pressure mentioned before.

Figure 3:
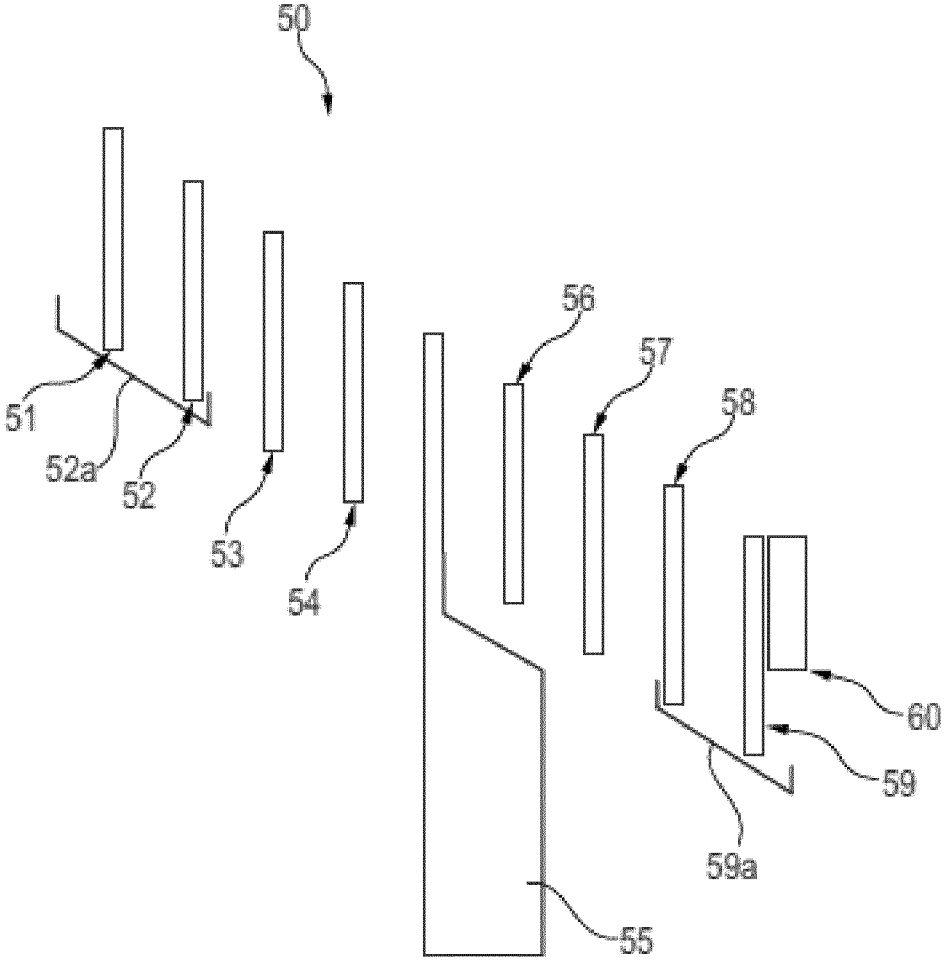
FIG. 3 shows a basic sketch of a multicollector in accordance with an embodiment of the invention.

FIG. 3 shows an embodiment and part of the multicollector according to the present invention. The basic sketch shows a detector arrangement or detector platform 50. In the perspective shown the ions come in from the top. A center detector 55 can be positioned in the center (axial position) which can be switchable between a Faraday cup or an ion counter. The center detector can be immobile (fixed position).

An axial channel can be equipped with a switchable collector channel behind a detector slit where the ion beam can be switched between a Faraday cup and an ion counting detector. On each side of this fixed axial channel there can be 4 (four) moveable detector platforms, each of them can carry one Faraday cup and attached to it one or more miniaturized ion counting channels. Every second platform is motorized and can be adjusted under computer control. The detector platforms between the two motorized platforms except for the axial center cup which has a fixed position are pushed and pulled into position by the one or both of the adjacent platforms, allowing for full position control on all moveable platforms.

In the arrangement shown ions with smaller mass are detected to the left of the center detector 55. In more detail. Faraday cup L1 with reference numeral 54 can be motorized or driven to change its position. To the further left Faraday cup L2 with reference numeral 53 may not have its own drive but may be driven or pushed by Faraday cup L1 54 to the left.

Faraday cup L3 with reference numeral 52 can have its own drive. It can be connected to Faraday cup L4 with reference numeral 51 by a connector or clamp 52*a* which can clamp the elements. With this arrangement Faraday cup L3 52 when being moved to the left in FIG. 3 pushes Faraday cup L4 51. When being moved to the right, Faraday cup L3 52 can pull Faraday cup 51 by the connector 52*a* to the right and can also further push Faraday cup L2 53 to the right.

To the right of the central detector 55 the detectors for higher masses can be arranged. In more detail, a Faraday cup H1 with reference numeral 56 can arranged and can have a drive or motor in order to be moved to each side. Faraday cup H2 with reference numeral 57 can have no drive or no motor but can be pushed to the right by H1 56. Further to the right Faraday cup H3 with reference numeral 58 can be motorized or driven. Similar to L3 Faraday cup H3 58 can push H2 57 to the left when moving to the left. Additionally it can pull by a second connector 59*a* Faraday cup H4 with reference numeral 59 to the left. Moving to the right H3 58 it can push H4 59.

In the embodiment shown, a miniaturized ion counter 60 can be assembled on the right hand side of H4 59. One or more miniaturized ion counters can be arranged either side of any Faraday cup.

As should be appreciated based on the foregoing description of the invention and some of its embodiments, the invention can provide advantages over mass spectrometers and methods of mass spectrometry that are known in the art. The precision and accuracy of the analyses can be considerably improved. For example, the invention allows for mass shift reactions in the collision cell, combined with mass filtering of the sample ions upstream of the collision cell, to improve specificity of measurement. Thus, some of the advantages of the present invention comprise attenuation, circumvention and/or even elimination of interferences, such as removing interfering molecular ions, particularly in the field of high resolution multicollector ICP-MS analyses. These advantages compensate the typical downsides of this nevertheless high precision and accurate isotope ratio analysis approach.

A problem to be solved in the field of the invention is the direct analysis of isotope ratios in small sized samples, particularly those that are not chemically prepared, for instance, in the case of direct laser ablation of a sample and coupling the laser ablation cell directly to a mass spectrometer for high precision isotope ratio analysis. In the case of the present invention, the specificity of the analysis is delivered by the mass analyser and its ion introduction system rather than through extensive sample isolation steps.

Some of the applications and operations of the invention will now be described with reference to an example in which a test sample is used to model a real type of sample in the form of a small heterogeneous meteorite sample and/or thin section(s), which should be analyzed for Ti isotope abundances in the presence of Ca, Sc, V, Cr, Mn and Cu using laser ablation and MC-ICPMS.

Table 1 shows possible isobaric interferences in the Ti isotope mass range for such a sample type:

TABLE 1

| Element | Isotopes | | | | | | | | | | | |
|---|---|---|---|---|---|---|---|---|---|---|---|---|
| Ca | 44Ca | | 46Ca | | 48Ca | | | | | | | |
| Sc | | 45Sc | | | | | | | | | | |
| Ti | | | 46Ti | 47Ti | 48Ti | 49Ti | 50Ti | | | | | |
| V | | | | | | | 50V | 51V | | | | |
| Cr | | | | | | | 50Cr | | 52Cr | 53Cr | 54Cr | |
| Mn | | | | | | | | | | | | 55Mn |

In this case there are three isobaric interferences on the Ti isotopes, which cannot be mass resolved even with high mass resolution on a sector mass analyser. As the sample introduction is by way of laser ablation, there is no means of chemical sample preparation to separate the elements by chemistry before the sample goes into the mass spectrometer. All specificity has to be provided by the sample introduction and the mass spectrometer.

The ablated sample material is transported from the laser ablation cell to the ICP source for instance by a flow of He gas or a mixture of He and Ar gas. The idea to overcome the isobaric interferences is to mass shift the ions by an oxidation reaction inside the collision cell by adding a small flow of a reactive gas, which is $O_2$ gas in this example, to the He gas inside the collision cell 30. As a result of the different oxide formation rates of the elements inside the collision cell a significant attenuation or even complete elimination of the interferences in the shifted mass spectrum (isotopes are shifted 16 amu due to oxidation) can be achieved. This gives a significant improvement of the specificity in the shifted mass spectrum already but it may not solve all problems. To further improve the specificity of the setup the mass filter 20 installed before the collision cell is operated to pre-select a certain mass range which enters the collision cell. This setup is different to previous setups, where only a collision cell was installed between the ICP interface and a multicollector mass spectrometer.

The quadrupole mass filter 20 can be user controlled to only transmit a single mass with a mass window of 0.7 amu or to select a larger mass windows capable of transmitting all isotopes of an element but discriminating against neighbouring masses e.g. mass 45 to mass 51 in case of Ti. The mass filter can also be set to full mass transmission mode where the quadrupole is operated with no DC potential so that there is no mass discrimination due to the quadrupole mass filter and the quadrupole acts only as an ion guide.

As a test of the system a test solution containing 0.5 ppm Ti, Cu, Ba and Sc is aspirated into the spray chamber of the ICP inlet system. The quadrupole mass filter is first set at full transmission for all masses, which means it is operated in RF-only mode, where the quadrupole has no mass discrimination function and operates as an ion guide for all masses. All ions are focused into the collision cell.

Figure 4:
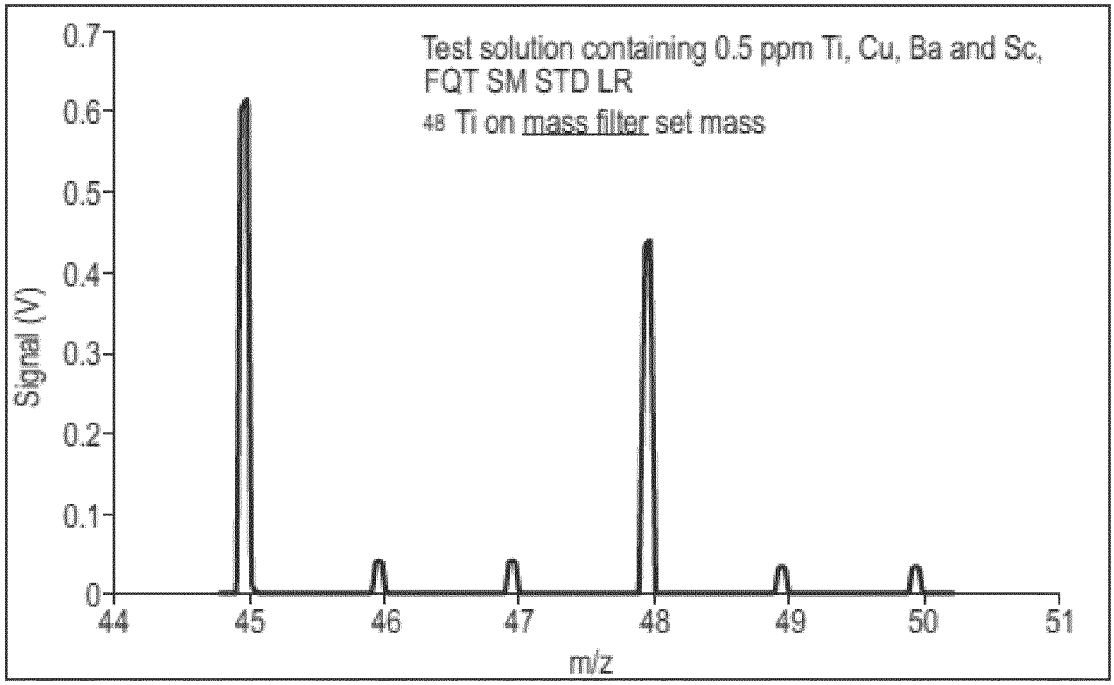
FIG. 4 demonstrates a mass spectrum of a test solution containing Ti, Cu, Ba and Sc with the quadrupole mass filter set to full transmission (ion guide mode) and no gas in the collision cell.

As a first test there was no gas in the collision cell. The ions are then accelerated from the exit of the collision cell into the ion optics of the double focussing multicollector mass spectrometer. The mass spectrum is recorded on the axial detector and shown in FIG. 4. One can clearly see the $^{45}$Sc peak and all 5 Ti isotopes. Ba and Cu do not show up in this spectrum.

Figure 5:
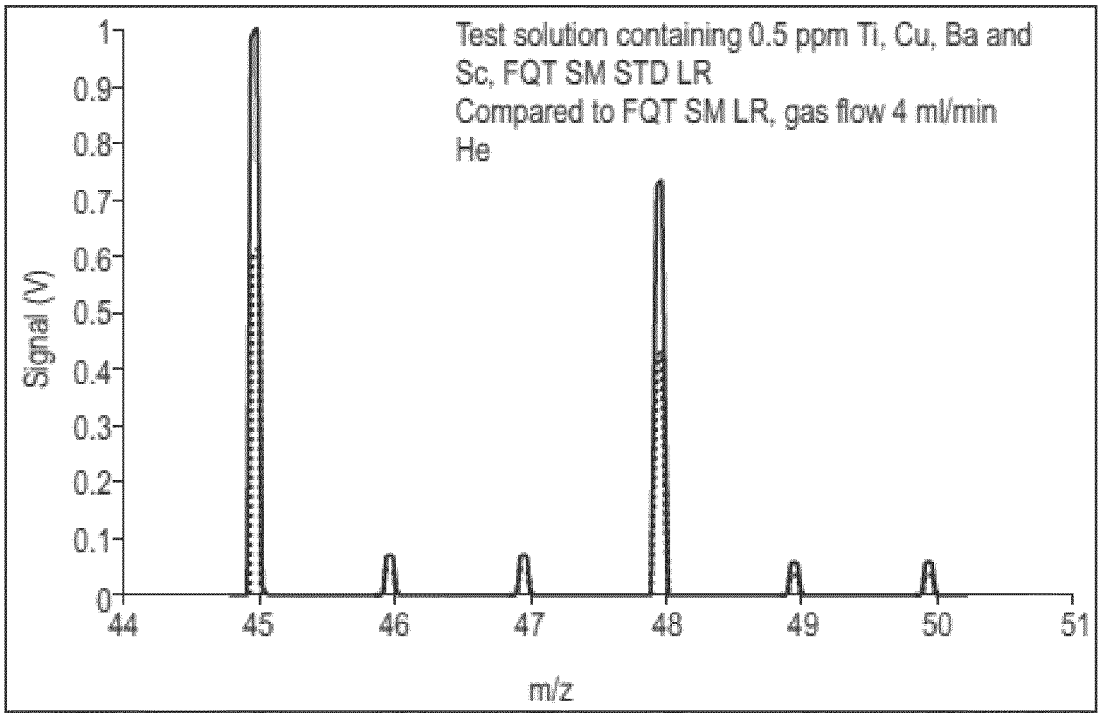
FIG. 5 corresponds to FIG. 4 but shows a collision cell flooded with He gas for collisional focusing.

As a next step the collision cell is flooded with He gas to achieve collisional focusing of the ion beam through the collision cell. This results in about a 60% signal increase compared to the mode with no gas for the collision cell as shown in FIG. 5. In this figure the dotted line relates to the spectrum without collision gas; the continuous line is used for the situation with collisional focusing. In case there would have been molecular species interfering with the elemental ions there would have been a chance to break the molecular bonds by collisions and to eliminate the molecular species from this part of the mass spectrum. Using collision gas improves sensitivity due to collisional focusing and potentially can fragment molecular interferences and thus leads to improved specificity.

In order to further improve the specificity of the analysis $O_2$ gas is added to the collision gas, the oxygen inside the collision cell results in the formation of oxides, promoting $Ti^+$ to $TiO^+$ and causing a mass shift the mass spectrum to a higher mass range. The oxide formation rate is different for different elements. This has the potential to be exploited in order to gain specificity. In this particular case, the oxide formation rate is similar for Ti and Sc so no specificity is gained.

Figure 6:
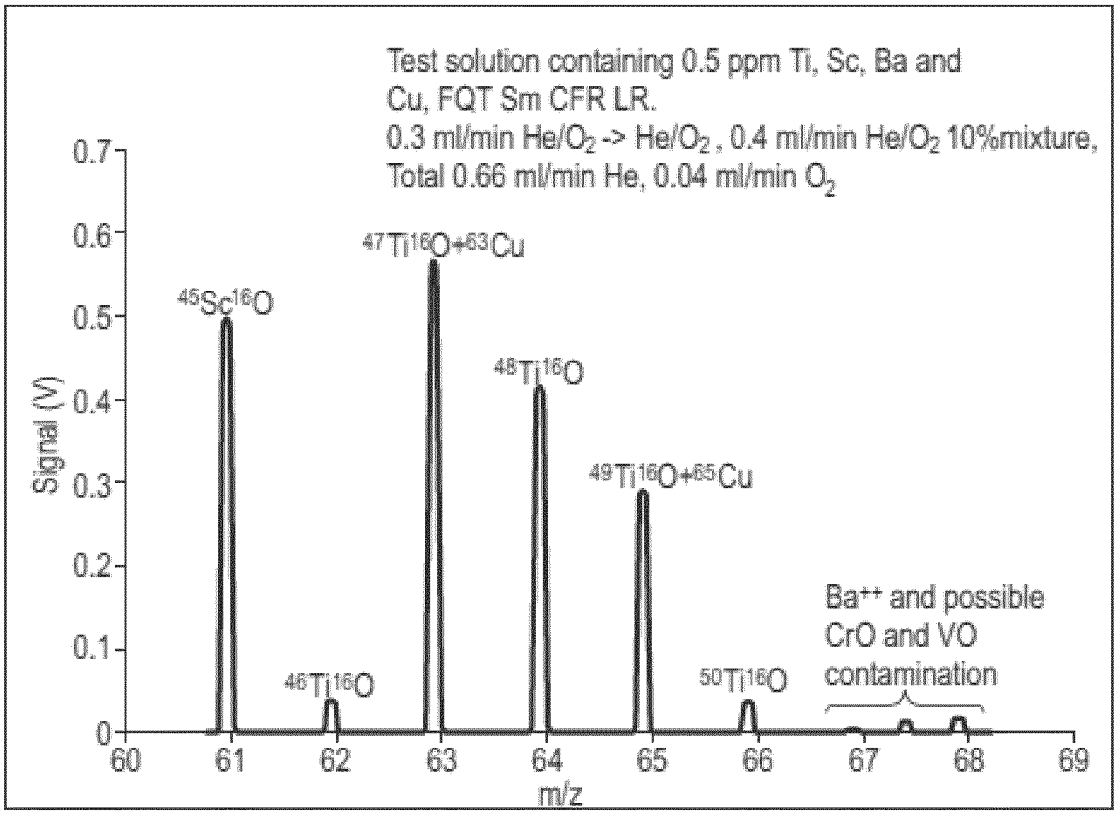
FIG. 6 shows a mass shifted $TiO^+$ and $ScO^+$ mass spectrum with $Cu^+$ background and $Ba^{++}$ contamination.

The Ti and Sc isotopes are shifted by oxide formation into the Cu mass range at mass 63 and 65, which are also transmitted when the mass filter is operated in full transmission mode. The resulting Cu and TiO spectrum is shown in FIG. 6.

Furthermore, an amount of doubly charged barium from the solution can clearly be detected at mass 67, 67.5 and 68.

Figure 7:
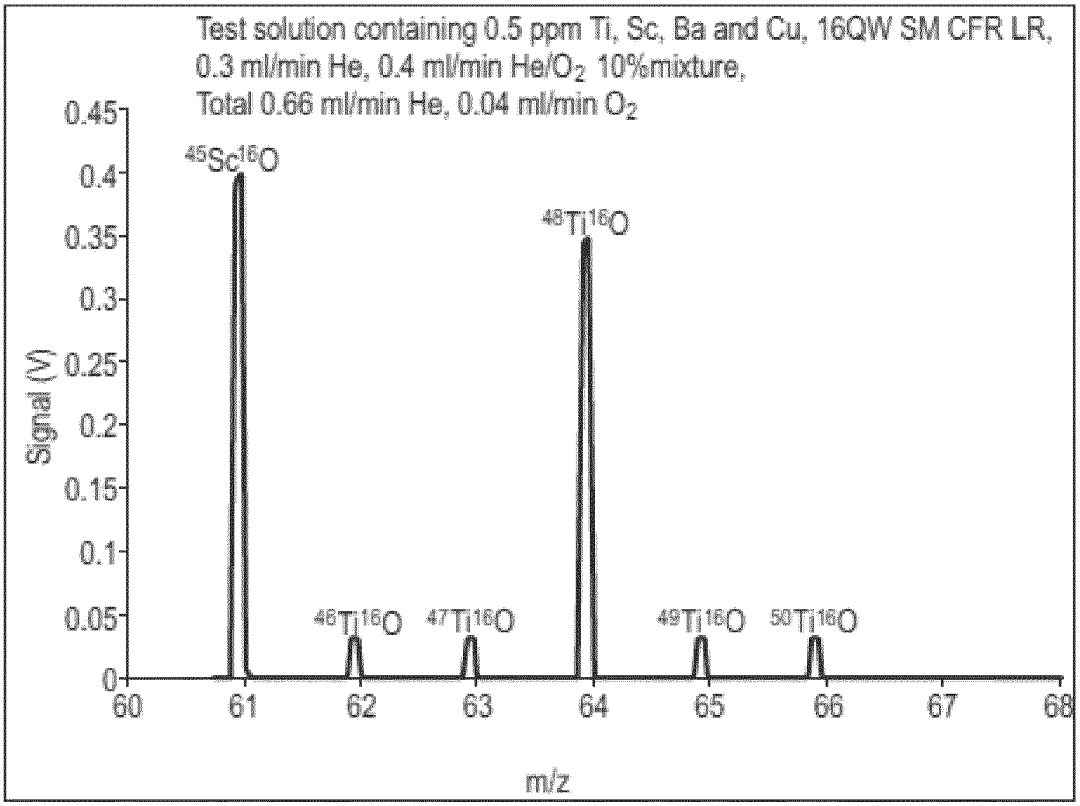
FIG. 7 shows the same region of the spectrum as FIG. 6, but with the quadrupole mass filter set to only transmit $^{48}Ti^+ \pm 8$ amu.

The Cu and Ba backgrounds potentially could reduce the specificity and thus result in an even more complicated situation than in the elemental spectra. This is where the mass filtering action of the quadrupole mass filter can be utilised. The quadrupole is then set with a mass window function of 16 amu centered around $^{48}$Ti. This means that Cu ions and Ba ions are discriminated by the mass filter action of the quadrupole mass filter and thus are no longer present in the ScO and TiO spectrum which is now interference free. The resulting mass spectrum is displayed in FIG. 7. Cu ions and Ba ions are removed from the mass spectrum because these ions are discriminated by the first quadrupole mass filter.

Therefore, it can be seen that the method of the invention in one embodiment can comprise: operating the mass filter to mass select the ion beam to transmit only ions within a pre-determined mass range and providing the collision cell with a reaction gas to react with at least one ion of interest in the mass selected ion beam, preferably an elemental ion of interest, thereby producing a mass-shifted ion of interest that lies outside the pre-determined mass range selected by the mass filter. Preferably, the width of the pre-determined mass range is not greater than the mass of the reaction gas. For example, where the reaction gas is oxygen the width of the pre-determined mass range can be 16 amu or less.

It has been shown above how collisional focusing can improve sensitivity and how mass shift reactions can shift the isotopes of interest into a different mass range where there are completely different backgrounds. Moreover, it has been discussed how mass shift reactions can be combined with mass filtering of a certain mass window using the quadrupole mass filter can eliminate spectral interferences in the mass shifted mass range so that the mass shifted mass spectrum appears on a clean background.

Turning to another scenario, it can be shown how differential oxide formation in different elements can be used to improve specificity in reaction schemes. To demonstrate this a 2 ppm solution of Ca, Ti, Cr and V is aspirated in the spray chamber of the ICP source. For this test, the first quadrupole mass filter is operated in full transmission mode and the collision cell is operated without reaction gas. The resulting elemental spectra is shown in FIG. 8.

Figure 9:
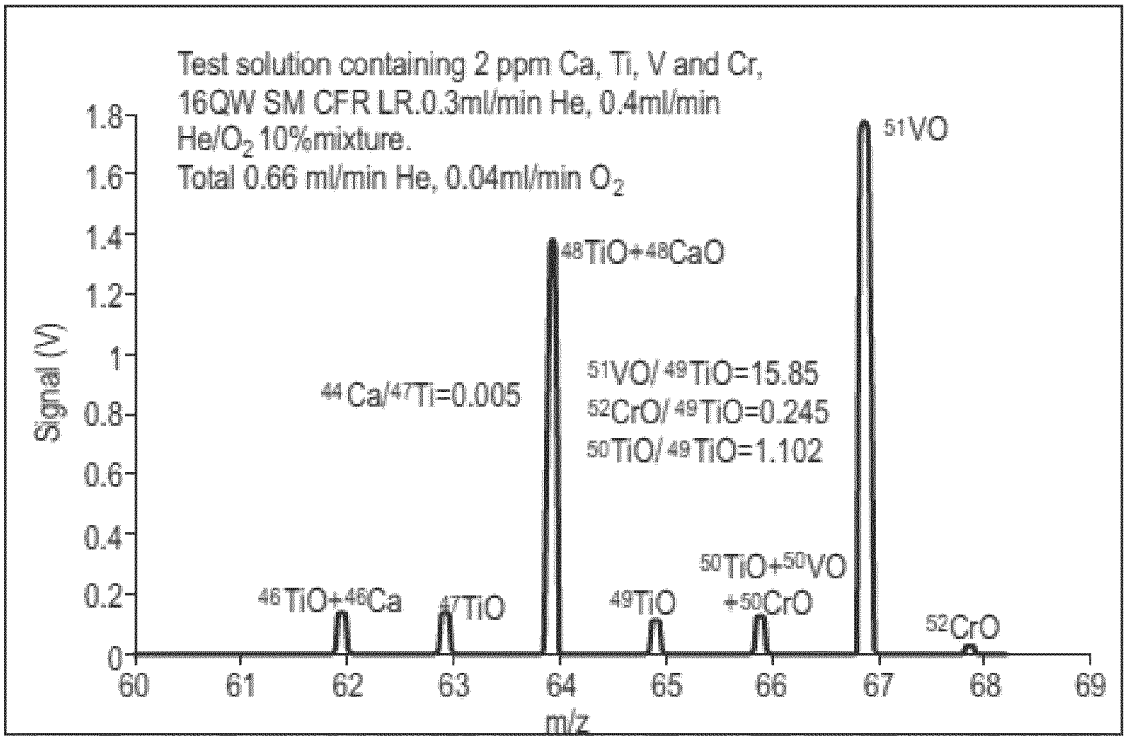
FIG. 9 shows a mass spectrum of Test solution containing 2 ppm of Ca, Ti, V and Cr, with collisional focusing by He and oxygen mass shift with $O_2$ addition to the collision cell wherein a quadrupole mass filter is set to mass window mode $^{48}Ti^+ \pm 8$ amu.

The $^{46}Ti^+$ and $^{48}Ti^+$ peaks are interfered with isobaric Ca isotopes. The $^{50}Ti^+$ peak is interfered by isobaric V and Cr isotopes. To demonstrate specificity in the present invention, mass filter quadrupole is set to a 16 amu window centred on $^{48}$Ti and then a flow of $O_2$ and He is introduced into the collision cell. The resulting mass shifted mass spectrum is shown in FIG. 9.

Both Ca and Ti are mass shifted by oxide formation in the collision cell. However, the oxide formation rate of Ti is about 100 times more efficient than for Ca (ratio of Ca to Ti goes from 0.4 to 0.005). This significantly reduces the contribution of Ca interferences on Ti. Since the $^{44}Ca^{16}O$ peak does not have any interference it can be used to monitor possible interferences on the TiO peaks and do interference corrections based on assumed Ca isotope abundances. The preferential oxide formation rate of Ti over Ca at least reduces the uncertainty in this correction by a factor of 10 which is a major improvement in specificity. The instrument can be further tuned for even higher specificity.

Figure 8:
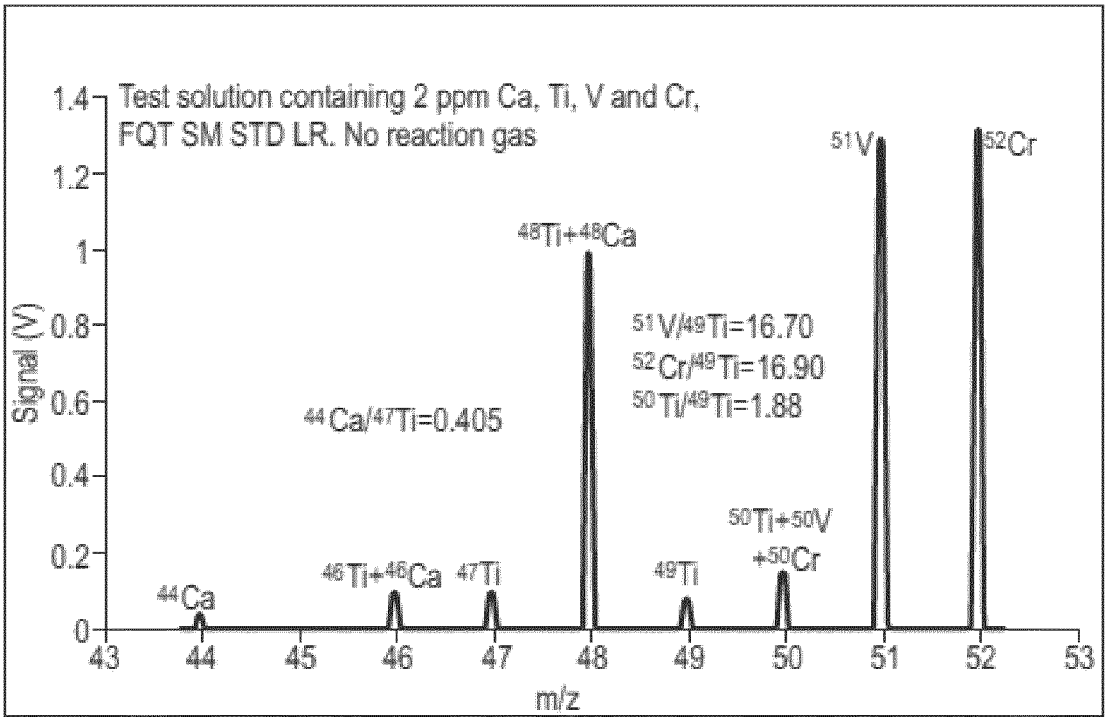
FIG. 8 shows a mass spectrum of Test solution containing 2 ppm of Ca, Ti, V and Cr, with the quadrupole mass filter set to full transmission (ion guide mode), and no gas in the collision cell, the spectrum being measured at an axial detector of the multicollector.

In FIG. 8, $^{50}Ti^+$ is interfered by $^{50}V^+$ and $^{50}Cr^+$ ions. This holds true for the mass shifted spectrum in FIG. 9 as well. While there is no gain for discrimination of $^{50}$V against $^{50}$Ti because both elements have similar oxide formation rates there is quite a dramatic discrimination for Cr interference on Ti. The oxide formation rate for Cr is about 69 times smaller compared to Ti under these conditions.

In the scenarios shown in FIG. 4 to FIG. 9 no simultaneous collection takes place. The mass scans of the Sc, Ti, V, Cr, Cu and Ba++ spectra are created by sweeping the voltage applied to the magnet to sequentially deflect each mass into the axial detector which then records the spectra.

In summary, these examples show that the combination of an ICP/Quad-filter/CCT/MC-MS instrument can significantly improve specificity for highly precise and accurate isotope abundance measurements of interfered sample material. As such it can greatly improve the ability for direct sample analysis with, for instance, laser ablation and without extended chemical preparation. Selecting certain mass windows covering at least the isotopes to be studied followed by a collision cell for fragmentation and/or charge exchange and/or mass shift reactions allow for significantly improved specificity for isotope ratio analysis.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. A mass spectrometer for determining isotope ratios comprising (a) at least one ion source for generating a beam of elemental ions from a sample;

(b) at least one mass filter downstream of the ion source operable to select ions from the beam by their mass-to-charge ratio (m/z) and to transmit only ions having mass within a mass window of at most 30 amu;

(c) at least one collision cell arranged downstream of the mass filter and adapted for inducing mass shift reactions to a higher mass within the collision cell for a plurality of target ion species;

(d) at least one sector field mass analyser, arranged downstream of the collision cell; and (e) at least one ion multicollector comprising a plurality of ion detectors arranged downstream of the mass analyser, for detecting the plurality of target ion species in parallel and/or simultaneously and determining isotope ratios, the ion species including different isotopes of the same element.

2. The mass spectrometer according to claim 1 wherein the ion source comprises an inductively coupled plasma ion source (ICP).

3. The mass spectrometer according to claim 1 further comprising a laser ablation cell for direct laser ablation of a sample, the laser ablation cell being arranged upstream of the ion source.

4. The mass spectrometer according to claim 1, wherein the collision cell contains at least one gas inlet for supplying at least one collision gas or reaction gas, so as to facilitate mass shift reactions and/or reduce the absolute kinetic energy and reduce the energy spread of the ions in the ion beam.

5. The mass spectrometer according to claim 1 wherein the mass filter comprises a quadrupole filter, an RF-only driven pre-filter section arranged upstream of the quadrupole filter and/or RF-only driven post-filter section arranged downstream of the quadrupole filter.

6. The mass spectrometer according to claim 5 wherein the quadrupole filter is adapted to be operable in a full mass transmission mode.

7. The mass spectrometer according to claim 5 wherein the pre-filter section and/or the post-filter section is adapted to be set to enhance control of the ion beam phase volume at the entrance of and/or within the quadrupole filter and/or to enhance transmission of the ion beam further downstream.

8. The mass spectrometer according to claim 1 wherein the at least one mass analyser comprises double focusing ion optics for simultaneously analysing a plurality of ion species.

9. The mass spectrometer according to claim 1 wherein the ion multicollector comprises at least one Faraday cup and/or at least one ion counter.

10. The mass spectrometer according to claim 1 wherein the ion multicollector comprises at least 3 Faraday cups and/or 2 ion counters.

11. The mass spectrometer according to claim 9 wherein the multicollector comprises at least one axial channel that comprises at least one switchable collector channel behind a detector slit for switching between a Faraday cup and an ion counter.

12. The mass spectrometer according to claim 1 wherein the mass filter is adapted to be operable to transmit mass within a predefined mass window.

13. The mass spectrometer according to claim 1 wherein the mass filter is adapted to be operable to transmit only ions having a mass within a mass window around a predefined mass, wherein the mass window has a width of at most 30%.

14. The mass spectrometer according to claim 1 wherein the mass filter is adapted to be operable to transmit only ions having a mass within a mass window around a predefined mass, wherein the width of the mass window is selected based on the ion mass range transmitted by the mass analyser to the multicollector.

15. The mass spectrometer according to claim 1 wherein the mass filter is adapted to be operable to (i) transmit only ions having a mass within a first mass window during a first time period in which the mass analyser is set to transmit ions of a first analysis mass range to the multicollector, the first mass window being selected based on the first analysis mass range, and (ii) transmit only ions having a mass within a second mass window during a second time period, following the first time period, in which the mass analyser is set to transmit ions of a second analysis mass range to the multicollector, the second mass window being selected based on the second analysis mass range, wherein the second analysis mass range is different to the first analysis mass range.

16. The mass spectrometer according to claim 1, wherein the quadrupole mass filter is adapted to transmit a single mass with a mass window of at most 0.9 amu.

17. The mass spectrometer according to claim 1 further comprising a filter for removing non-ionic species that is arranged upstream from the mass filter.

18. The mass spectrometer according to claim 1 further comprising at least one source of gas and at least one inlet of gas.

19. Kit for a multi-detector mass spectrometer, particularly according to claim 1, comprising at least one mass filter to select ions from an ion beam by their mass-to-charge ratio (m/z), the mass filter being adapted to be arranged downstream of the ion source, being further adapted to be arranged upstream of at least one collision cell and at least one sector field mass analyser, arranged downstream of the collision cell and at least one ion multicollector comprising a plurality of ion detectors arranged downstream of the mass analyser, for detecting a plurality of different ion species in parallel and/or simultaneously.

20. A method of analysing the composition of at least one sample and determining at least one elemental ratio comprising:

(a) generating a beam of elemental ions from a sample in an ion source;

(b) selecting ions of the ion beam by at least one mass filter downstream of the ion source operable to selectively transmit only ions with mass to charge ratio (m/z) in a pre-determined range within a mass window of at most 30 amu;

(c) transmitting the selected ions through at least one collision cell downstream of the mass filter wherein the target ions are mass-shifted and cooled to reduce spread of their kinetic energy;

(d) separating the ions transmitted from the collision cell in a sector field analyser based on their mass to charge ratio;

(e) detecting the target ions in a multicollector in parallel and/or simultaneously; and (f) determining and/or measuring isotope ratios of isotopes contained in the sample.

21. The method according to claim 20 wherein the ions are generated by an inductively coupled plasma ion source (ICP).

22. The method according to claim 20 wherein analysing the composition comprises determining an isotopic ratio in the sample.

23. The method according to claim 20 further comprising preparing the sample from a geological, geochemical and/or biogeochemical resource before step (a) and a step of determining and/or measuring of isotope ratios of isotopes contained in the sample after step (e).

24. The method according to claim 20 further comprising preparing the sample from a cosmological and/or cosmochemical resource before step (a).

25. The method according to claim 20 further comprising preparing the sample from a life science resource before step (a) and a step of determining and/or measuring isotope ratios of isotopes contained in the sample after step (e).

26. The method according to claim 20 wherein before step (a) a sample is provided and then ablated by laser.

27. The method according to claim 20, further comprising delivering at least one gas into the collision cell, for cooling down the ion beam in the collision cell, and at least one second gas, for inducing mass shift reactions in the collision cell.

28. The method according to claim 27 comprising a step of delivering He as a major gas into the collision cell.

29. The method according to claim 20 wherein the mass filter is operated (i) to transmit only ions having a mass within a first mass window during a first time period in which the mass analyser is set to transmit ions of a first analysis mass range to the multicollector, the first mass window being selected based on the first analysis mass range, and (ii) to transmit only ions having a mass within a second mass window during a second time period, following the first time period, in which the mass analyser is set to transmit ions of a second analysis mass range to the multicollector, the second mass window being selected based on the second analysis mass range, wherein the second analysis mass range is different to the first analysis mass range.

30. The method according to claim 20 wherein the mass filter is operated to mass select the ion beam to transmit only ions within a pre-determined mass range and the collision cell is provided with a reaction gas to react with at least one ion of interest in the mass selected ion beam thereby producing a mass-shifted ion of interest that lies outside the pre-determined mass range selected by the mass filter.

* * * * *